US009112276B2

(12) United States Patent
Desclos et al.

(10) Patent No.: US 9,112,276 B2
(45) Date of Patent: Aug. 18, 2015

(54) WIDEBAND ANTENNA WITH LOW PASSIVE INTERMODULATION ATTRIBUTES

(71) Applicants: Laurent Desclos, San Diego, CA (US); Jeffrey Shamblin, San Marcos, CA (US)

(72) Inventors: Laurent Desclos, San Diego, CA (US); Jeffrey Shamblin, San Marcos, CA (US)

(73) Assignee: ETHERTRONICS, INC., San Diego, CA (US)

( * ) Notice: Subject to any disclaimer, the term of this patent is extended or adjusted under 35 U.S.C. 154(b) by 239 days.

(21) Appl. No.: 13/848,618

(22) Filed: Mar. 21, 2013

(65) Prior Publication Data

US 2013/0285877 A1 Oct. 31, 2013

Related U.S. Application Data

(60) Provisional application No. 61/613,492, filed on Mar. 21, 2012.

(51) Int. Cl.

| | |
|---|---|
| ***H01Q 13/00*** | (2006.01) |
| ***H01Q 1/42*** | (2006.01) |
| ***H01Q 9/04*** | (2006.01) |
| ***H01Q 1/12*** | (2006.01) |
| ***H01Q 9/36*** | (2006.01) |
| ***H01Q 5/371*** | (2015.01) |

(52) U.S. Cl.

CPC ..... *H01Q 1/42* (2013.01); *H01Q 1/1207* (2013.01); *H01Q 5/371* (2015.01); *H01Q 9/04* (2013.01); *H01Q 9/36* (2013.01); *Y10T 29/49016* (2015.01)

(58) Field of Classification Search

USPC ..... 343/752, 834, 846, 848, 872; 29/600

See application file for complete search history.

(56) References Cited

U.S. PATENT DOCUMENTS

| | | | | |
|---|---|---|---|---|
| 6,121,935 | A * | 9/2000 | Reece et al. | 343/725 |
| 2004/0263400 | A1 * | 12/2004 | Yuanzhu | 343/702 |
| 2005/0140554 | A1 * | 6/2005 | Wang et al. | 343/702 |
| 2009/0224991 | A1 * | 9/2009 | Rowson et al. | 343/747 |

* cited by examiner

*Primary Examiner* — Tan Ho

(74) *Attorney, Agent, or Firm* — Coastal Patent Law Group, P.C.

(57) ABSTRACT

An antenna assembly with wide bandwidth and low Passive Intermodulation (PIM) characteristics is described for use in Distributed Antenna Systems (DAS) and other applications which require low PIM levels. The antenna can be configured to cover multiple cellular frequency bands to provide a single antenna solution for use with multiple transceivers. A single conductor radiator design along with features integrated into the ground plane result in low PIM characteristics during high power transmission. One or multiple parasitic elements can be coupled to the driven antenna to enhance bandwidth while still maintaining low PIM characteristics.

17 Claims, 14 Drawing Sheets

WIDEBAND ANTENNA WITH LOW PASSIVE INTERMODULATION ATTRIBUTES

CROSS-REFERENCE TO RELATED APPLICATIONS

This application claims benefit of priority with U.S. Provisional Ser. No. 61/613,492, filed Mar. 21, 2013, and titled "WIDEBAND ANTENNA WITH LOW PASSIVE INTERMODULATION ATTRIBUTES"; the contents of which are hereby incorporated by reference.

BACKGROUND OF THE INVENTION

1. Field of the Invention

This invention relates generally to the field of wireless communication. In particular, the present invention relates to a wideband antenna having low passive intermodulation attributes for use within a distributed antenna system, the antenna being configured for robust multi-band operation for use in wireless communications.

2. Description of the Related Art

Continued adoption of cellular systems for data transfer and voice communications, along with the introduction of new mobile communications devices, such as tablet devices and the like, make cellular coverage in urban environments an increasing priority. In particular, improving cellular coverage indoors is important to provide a seamless user experience in the mobile communication arena. Distributed antenna systems are becoming increasingly popularized within office buildings and public areas and are used to provide stronger RF signals to improve the communication link for cellular and data services.

A distributed antenna system, or DAS, is a network of spatially separated antenna nodes connected to a common source via a transport medium that provides wireless service within a geographic area or structure. The idea is to split the transmitted power among several antenna elements, separated in space so as to provide coverage over the same area as a single antenna but with reduced total power and improved reliability. A single antenna radiating at high power is replaced by a group of low-power antennas to cover the same area.

Initial distributed antenna systems were only required to operate over a few frequency bands, resulting in a simplified antenna design process. However, as the communications industry has moved from 2G to 3G cellular systems, and with the advent of 4G communication systems such as Long Term Evolution (LTE), additional frequency bands are required from distributed antenna systems, resulting in more complicated antenna design.

As the density of mobile communication users increases in office buildings and public spaces, and as more users access high data rate features such as file sharing and video downloads, the signal to noise characteristics and RF signal levels of the cellular signals indoors become increasingly important parameters.

To maintain low noise floors in communication systems an important parameter for addressing in the antenna design is Passive Intermodulation (PIM). PIM products are generated when two RF signals at different frequencies are injected into an antenna port; the antenna, though being a passive device, can generate spurious responses due to "natural diode" junctions in the antenna. These natural diode junctions can be formed at the junction of two metal surfaces where the metals are dissimilar. Corrosion and oxidation at these junctions can also cause spurious frequency components due to mixing of the two RF signals. Proper antenna design and material selection is important to meet stringent, low PIM requirements. As PIM components increase, these spurious frequency components add to the noise level, which in turn results in reduced signal to noise ratio of the communication system. This will result in reduced data rates for users.

Thus, modern wireless trends are shaping a need for improved antennas for use within distributed antenna systems, the antennas being capable of wideband operation and low passive modulation attributes.

SUMMARY OF THE INVENTION

A wideband antenna for use in distributed antenna systems is described, the antenna being capable of efficient transmission and reception in multiple frequency bands while maintaining low passive intermodulation (PIM) performance.

DETAILED DESCRIPTION OF THE PREFERRED EMBODIMENTS

Figure 1:
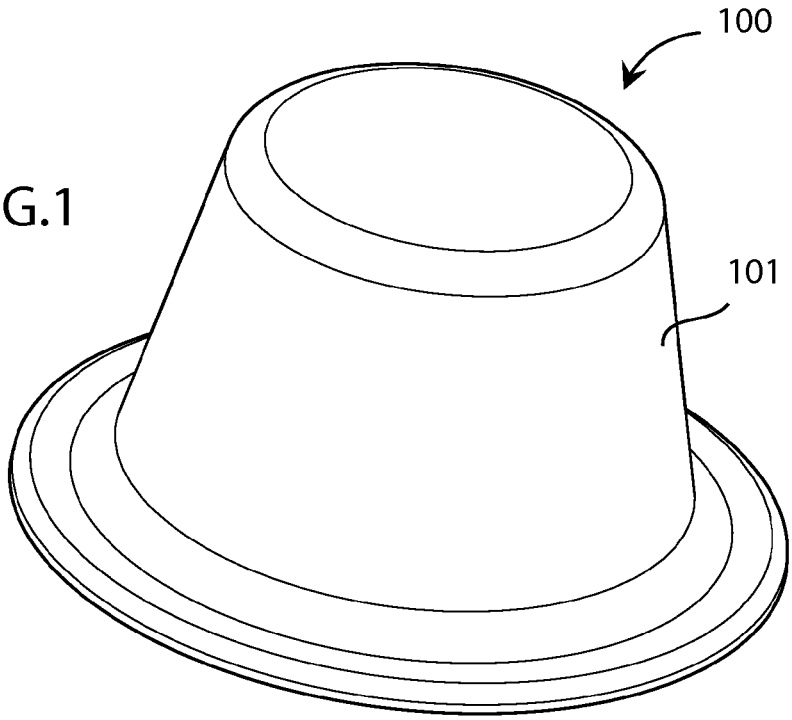
FIG. 1 illustrates a top perspective view of the antenna housing according to an embodiment of the invention.

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In a general embodiment, the invention provides a wideband antenna for use in distributed antenna systems, the antenna being capable of efficient transmission and reception in multiple frequency bands while maintaining low passive intermodulation (PIM) performance.

Within the general embodiment, a first conductor element is vertically disposed within an antenna housing, the first conductor element originates from a planar stock and is cut and bent to form a planar body portion and a planar top portion aligned substantially perpendicular to the planar body portion. The first conductor element further comprises one or more configurable flap portions cut out from the planar body portion and adapted to be bent into a configured position at an angle with respect to the planar body portion. A second planar conductor element is horizontally disposed within the antenna housing and comprises a non-conductive bracket attached at a hole disposed at or near a center thereof. The first conductor is attached to the second conductor at the non-conductive support bracket, thus forming an antenna radiator positioned above a ground plane. The first conductor further comprises a transmission line conductor extending therefrom through the hole of the second conductor. A coaxial cable is connected such that the second conductor is connected to ground and the transmission line conductor is connected to the antenna feed.

In certain embodiments, a third conductor or "parasitic conductor element" is positioned adjacent to the first conductor or "antenna radiator". The third conductor is dimensioned to resonate at a frequency to provide increased bandwidth at one or multiple resonances of the antenna formed by the first and second conductors.

In certain other embodiments, one or more apertures are disposed on the base plate or "ground plane". The apertures comprise dimensions designed to alter the Passive Intermodulation (PIM) characteristics of the antenna formed by the combination of the first and second conductors.

In certain other embodiments, one or more dielectric volumes of material can be disposed at or near the apertures of the base plate. The dielectric material provides a mechanism for altering the PIM characteristics of the antenna.

In certain other embodiments, one or more coupled or connected plates may be positioned adjacent to the horizontal top portion of the first conductor.

Moreover, in certain other embodiments, an active tuning element is provided. The active tuning element may be used to connect the third conductor to the base plate. An additional signal may be provided to control the active tuning element. In this regard, impedance or phase of the third conductor can be actively adjusted. The active tuning element may comprise any tunable capacitor, switch, varactor diode, PIN diode, or other component that can be used to alter impedance of phase delay. By adjusting the impedance and/or phase of the third conductor, the frequency response of the antenna can be adjusted.

The antenna can be configured to cover multiple cellular frequency bands to provide a single antenna solution for use with multiple transceivers. A single-conductor antenna radiator design along with features integrated into the antenna ground plane result in low PIM characteristics during high power transmission. One or multiple parasitic elements can be coupled to the driven antenna radiator to enhance bandwidth while still maintaining low PIM characteristics.

Various features and advantages of this invention will become apparent from the following description of embodiments with reference to the accompanying drawings. Hereinafter, certain preferred embodiments of the present invention will be described in more detail referring to the drawings and reference numerals associated thereof.

Now turning to the drawings, FIG. 1 illustrates a top perspective view of the antenna assembly 100 and outer housing 101 thereof in accordance with various embodiments of the invention. The housing is generally a non-conductive plastic structure. The antenna and housing are collectively referred to herein as the "antenna assembly 100".

Figure 2:
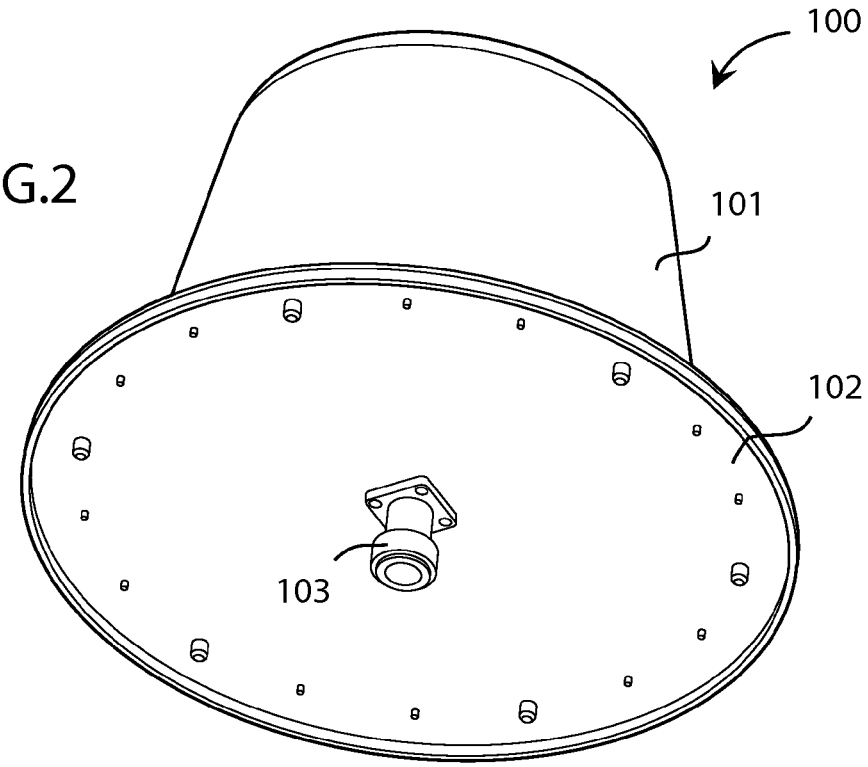
FIG. 2 illustrates a bottom perspective view of the antenna of FIG. 1.

FIG. 2 further illustrates the antenna and housing of FIG. 1 with a bottom perspective view thereof. A coaxial connector 103 is disposed at the bottom side of the base plate 102 at or near a center thereof.

Figure 3:
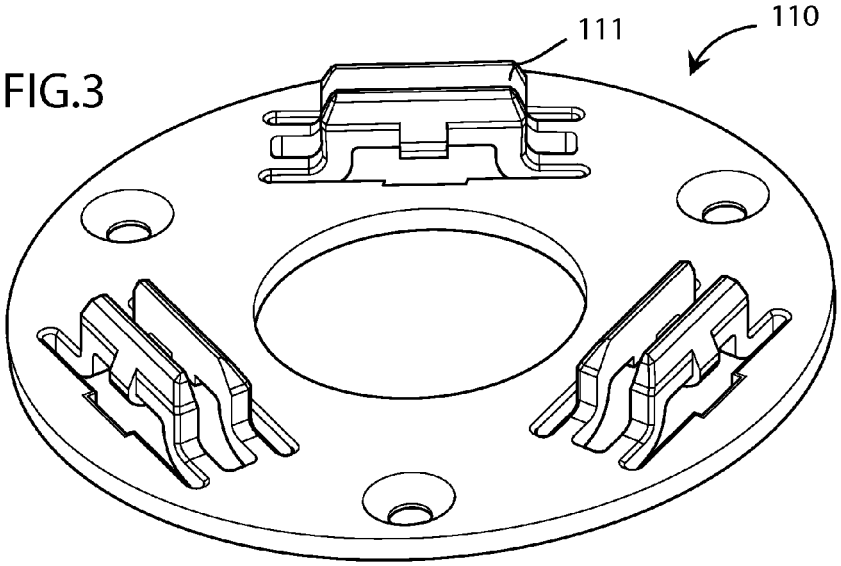
FIG. 3 illustrates a mounting bracket adapted for mounting the antenna housing of FIG. 1 to a flat surface.

FIG. 3 illustrates a mounting bracket 110 for use in mounting the antenna assembly with a ceiling or wall. One or more clips 111 may extend from the mounting bracket and can be formed of a dielectric material. The clips can be adapted to engage a portion of the base plate of the antenna assembly.

Figure 4:
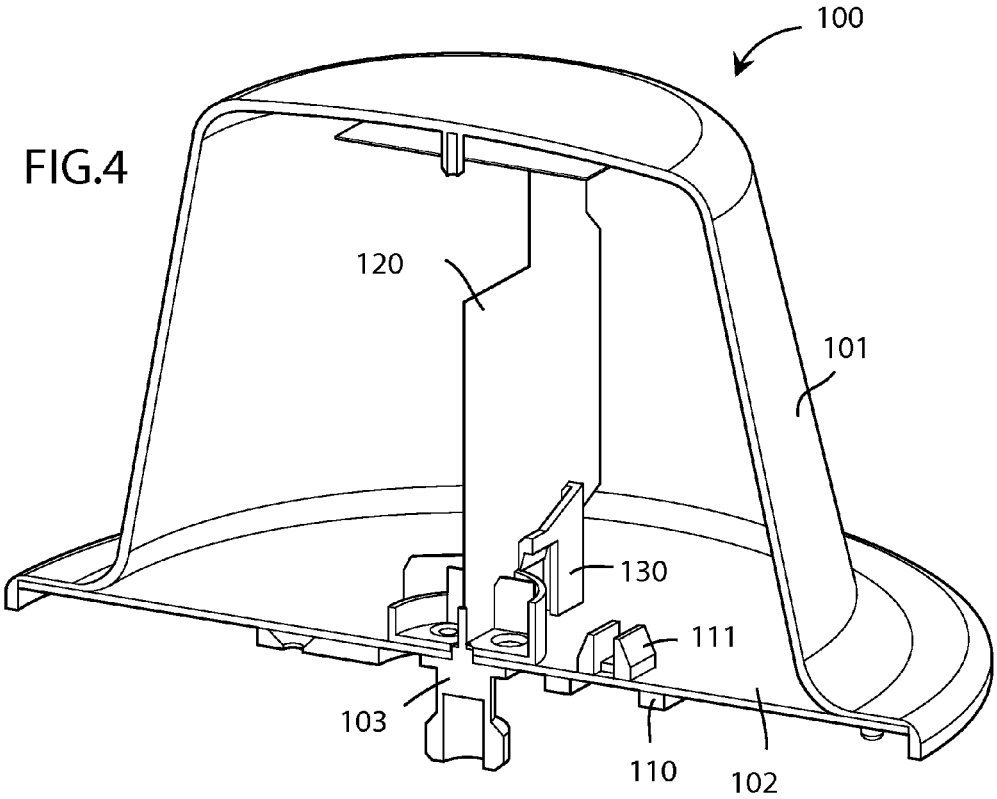
FIG. 4 illustrates a cross section of an antenna and housing in accordance with FIGS. 1-3.

FIG. 4 illustrates a cross section of the antenna assembly 100 in accordance with a preferred embodiment. The antenna assembly comprises a first conductor 120 or "antenna radiator" being vertically disposed above a horizontal second conductor 102 or "base plate/ground plane". The first conductor 120 is structurally supported above the second conductor 102 by a non-conductive support bracket 130. The first conductor is further connected to a transmission line conductor extending through a hole near a center of the second conductor and coupled to a feed portion of the coaxial connector 103. One or more non-conductive clips 111 may extend from the mounting bracket 110. The antenna housing 101 surrounds and protects the antenna components.

Figure 5:
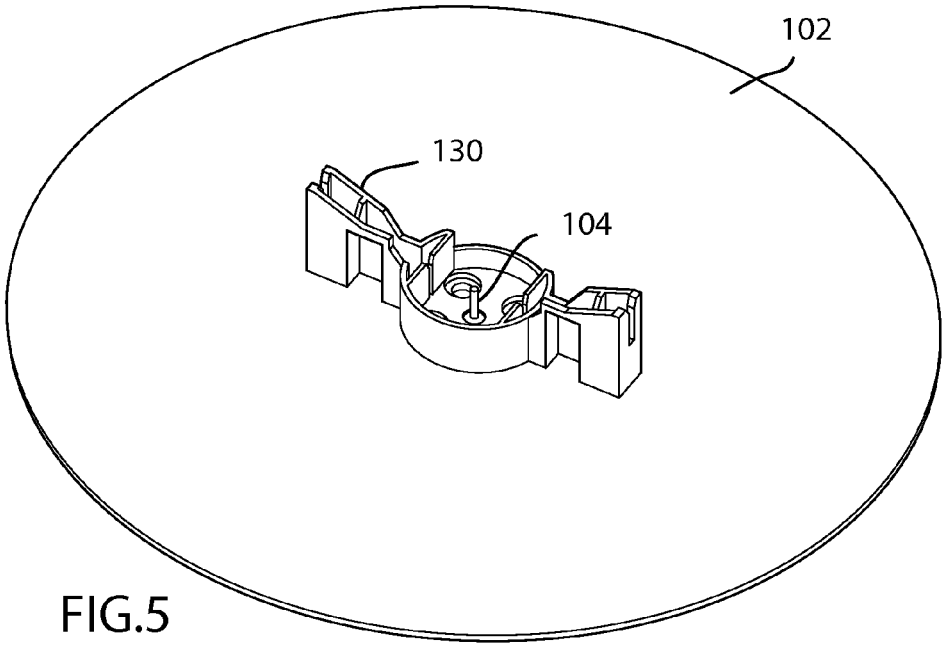
FIG. 5 illustrates a base plate for receiving an antenna element in accordance with certain embodiments; the base plate forms a ground plane.

FIG. 5 further illustrates a top perspective view of the base plate 102 having a hole disposed near a center thereof and a non-conductive support bracket 130 attached at the hole. The transmission line conductor 104 extends through the hole of the second conductor and a hole of the support bracket 130 such that the first conductor can be connected therewith.

Figure 6:
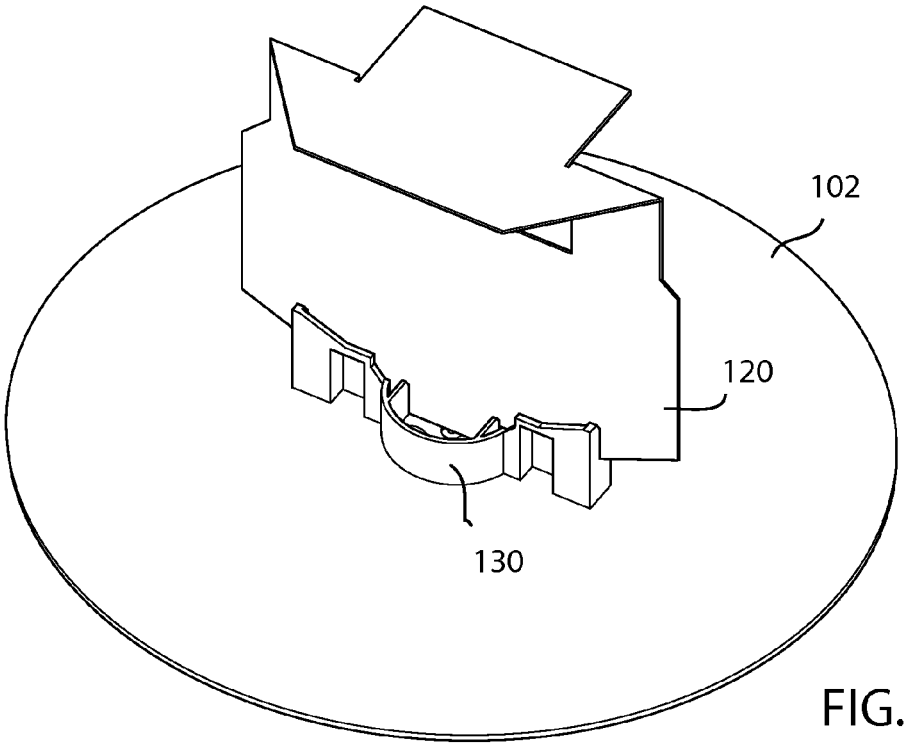
FIG. 6 illustrates a wideband antenna received within a portion of the base plate of FIG. 5.

FIG. 6 illustrates a top perspective view of the antenna in accordance with embodiments illustrated in the previous figures. The first conductor 120 or "antenna radiator" is disposed at the non-conductive support bracket 130 and extends upwardly therefrom. Thus, the antenna radiator is vertically disposed above the base plate 102.

Figure 7:
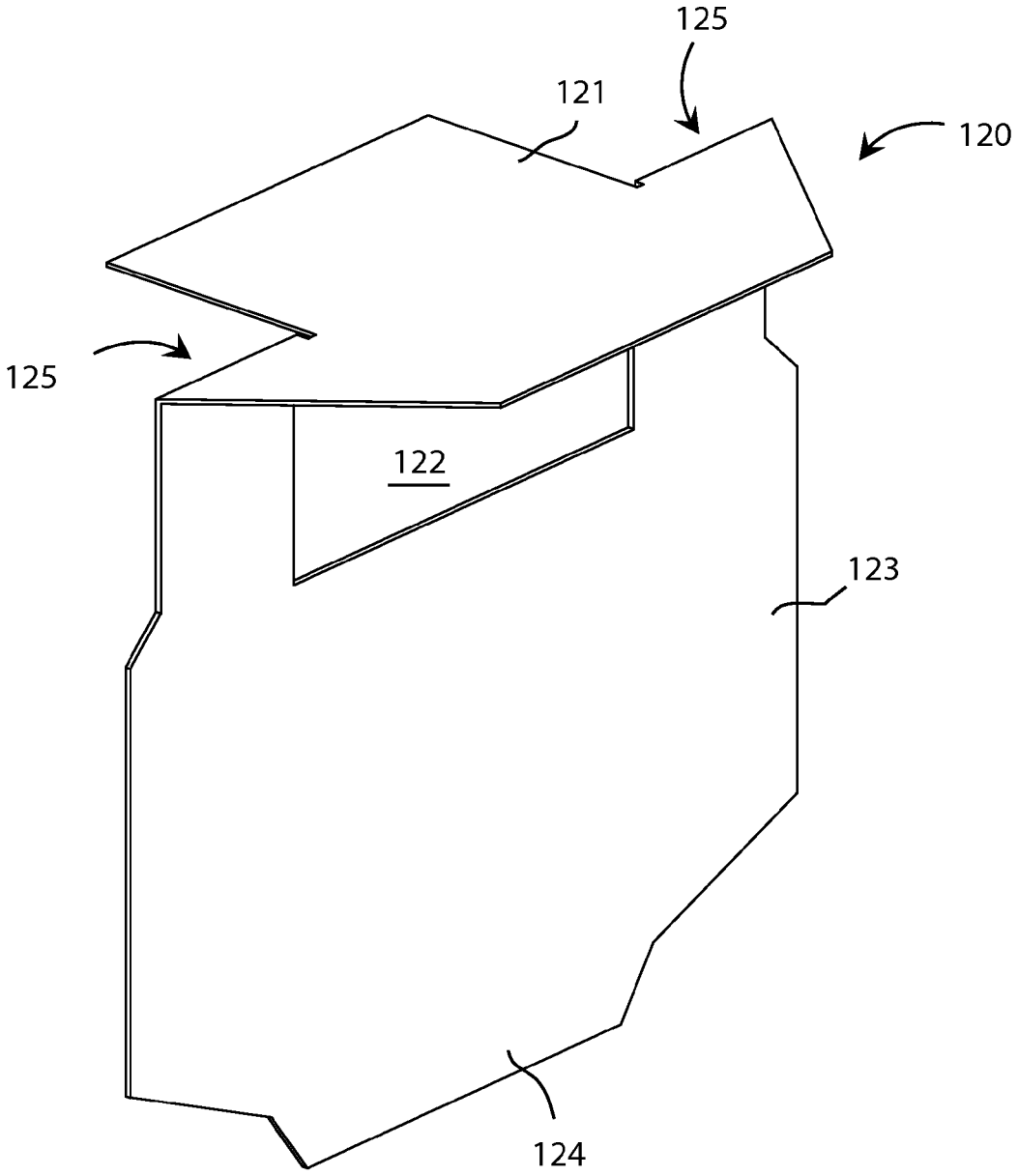
FIG. 7 illustrates a wideband antenna according to various embodiments.

FIG. 7 illustrates the first conductor 120 in accordance with various embodiments of the invention. The first conductor comprises a vertically disposed body portion 123 extending from a bottom end 124 to a top end. The first conductor is cut to allow a top portion thereof to be bent at one or more edges 125 and configured such that the top portion forms a T-shape when viewed from a side thereof. In this regard, the first conductor 120 comprises a horizontally disposed top portion 121 being substantially perpendicularly disposed with respect to a vertically disposed planar body portion 123. With a portion being cut and bent to form the planar top portion 121, a hole 122 resides between the top portion 121 and the body portion.

Regarding the antenna radiator, a monolithic conductive plate can be etched or cut in a u-shape, and the top portion folded along two resulting edges such that a top portion forms a t-shape structure with the body portion when viewed from a side thereof.

Figure 8A:
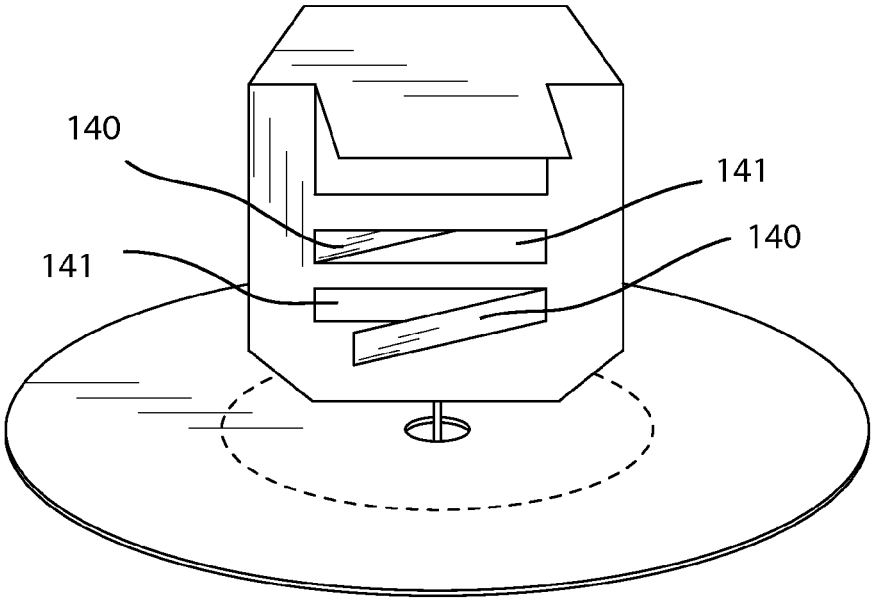
FIGS. 8 (A-B) illustrate an antenna having configurable flap portions, and an RF current flow induced on the ground plane, respectively.

Now turning to another embodiment, FIG. 8 illustrates an antenna as described in the previous figures and further comprising one or more configurable flap portions etched or cut from the body portion of the antenna radiator. The configurable flap portions can be bent or shaped to provide adjustment of the RF current induced on the antenna radiator such that PIM characteristics of the antenna can be improved.

Figure 8B:
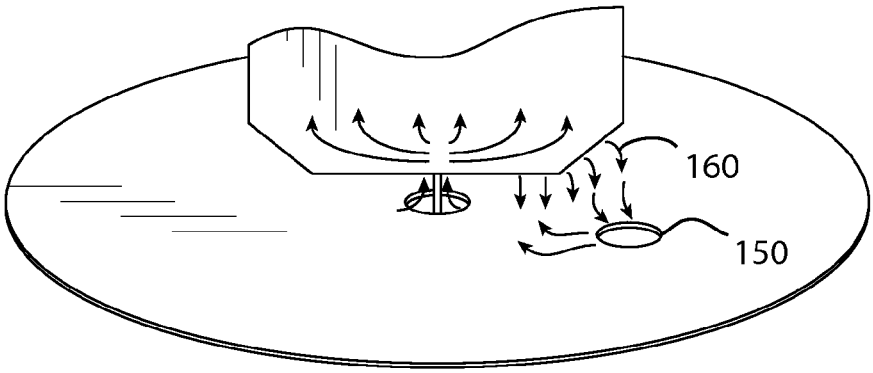

FIG. 8B illustrates radiofrequency (RF) currents being induced on the antenna radiator, and the coupling between the antenna radiator and the base plate. An aperture 150 is disposed on the base plate of the antenna for canceling, absorbing, or reflecting the RF currents 160 for improving the PIM attributes of the antenna assembly. The size and or shape of the aperture 150 can be tailored to alter the PIM attributes of the antenna.

Moreover, in FIGS. 8(A-B), the antenna radiator is positioned above the ground plane. The top portion of the antenna radiator is bent in a fashion to provide top loading of the antenna radiator. To achieve the top loading, a section of the body portion is cut to allow for formation of a three-dimensional element from a two dimensional element. Two configurable flap portions of the antenna body are formed into a three-dimensional shape. The transmission line conductor is attached to antenna radiator and is used to transmit and receive signals to and/or from the antenna. RF current flow on the antenna radiator is shown, along with coupling of the electric field to the ground plane. RF current flow induced on the ground plane and reflected from an aperture in the ground plane is shown.

Figure 9A:
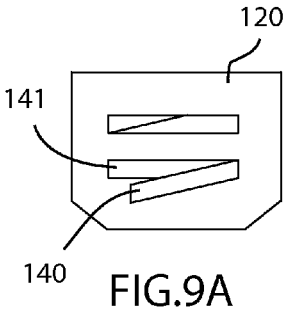
FIGS. 9(A-B) illustrate a side view, and top view, of an antenna having configurable flap portions arranged at acute angles with respect to the antenna radiator, respectively.
Figure 10A:
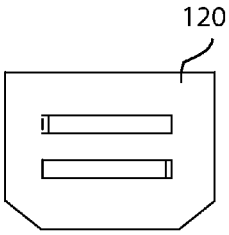
FIGS. 10(A-B) illustrate a side view, and top view, of an antenna having configurable flap portions arranged at right angles with respect to the antenna radiator, respectively.
Figure 11A:
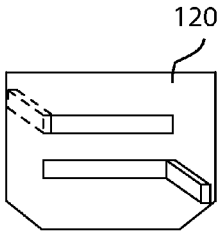
FIGS. 11(A-B) illustrate a side view, and top view, of an antenna having configurable flap portions arranged at obtuse angles with respect to the antenna radiator, respectively.
Figure 9B:
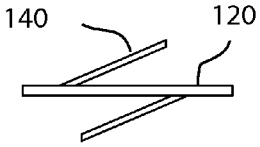
Figure 10B:
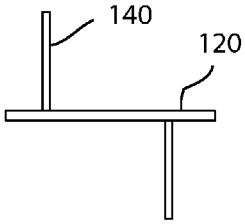
Figure 11B:
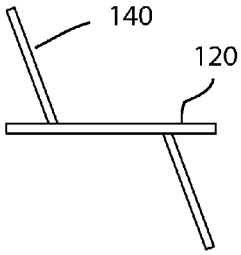

FIGS. 9-11 illustrate a number of configurations that may be provided using the configurable flap portions of the antenna radiator. In FIGS. 9(A-B), the configurable flap portions 140 are individually bent to form acute angles with respect to the planar body portion of the antenna radiator 120. In FIGS. 10(A-B), the configurable flap portions 140 are individually bent to form right angles with respect to the planar body portion of the antenna radiator 120. And in FIGS. 11(A-B), the configurable flap portions 140 are individually bent to form obtuse angles with respect to the planar body portion of the antenna radiator 120. It should be noted that other configurations are possible, and that such configurations can be implemented and studied by those having skill in the art to determine associated antenna characteristics. In this regard, only one configurable flap portion may be provided, or two or more may be provided having independent non-symmetrical configurations. Thus these representations are for illustrative purposes and are not intended to be exhaustive of the possible configurations.

Figure 12:
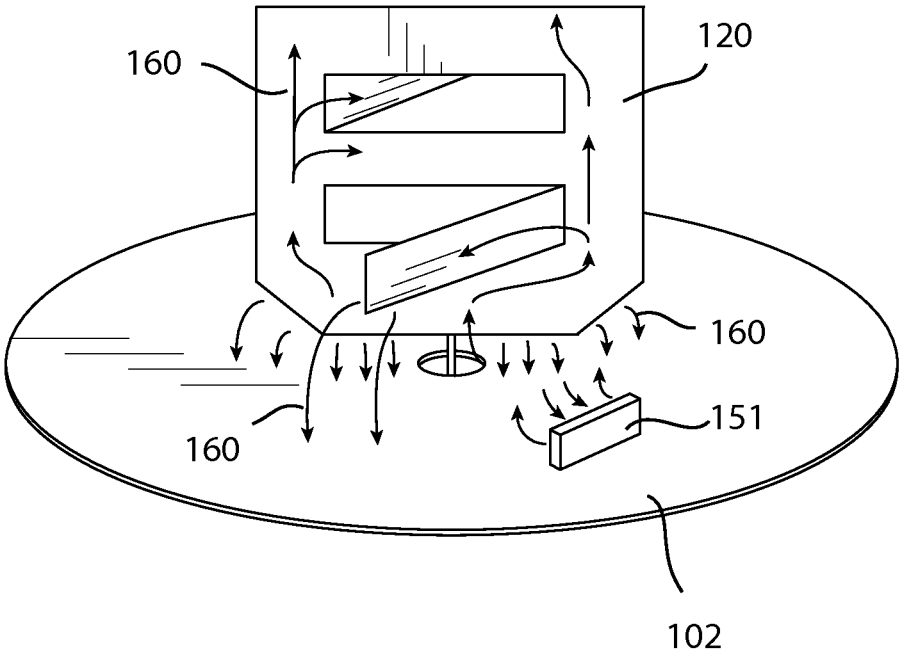
FIG. 12 illustrates an antenna with configurable flaps shaped to alter the antenna near field, and an associated RF current flowing about the antenna radiator.

FIG. 12 further illustrates the antenna of FIGS. 8-11, wherein RF currents 160 are distributed about the antenna radiator 120 and base plate 102. Additionally, a dielectric volume 151 is positioned at an aperture and provided for adjusting the PIM attributes of the antenna, RF currents 160 are reflected from the aperture and dielectric volume of material 151 thereon.

Figure 13:
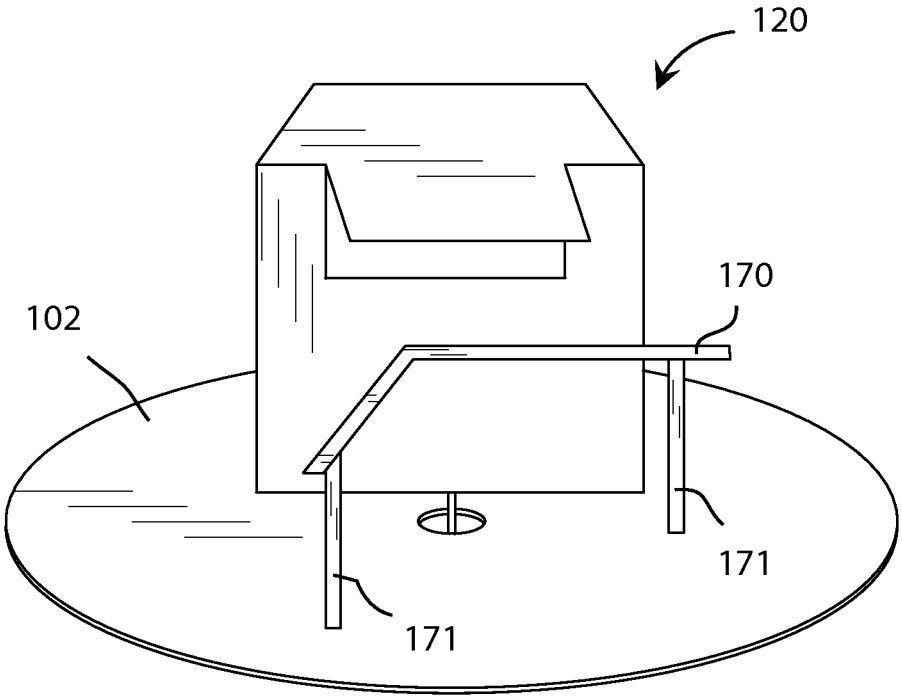
FIG. 13 illustrates an antenna according to various embodiments, the antenna comprising a parasitic conductor element positioned adjacent to the antenna radiator and supported by non-conductive vertical supports extending upwardly from the base plate.
Figure 14:
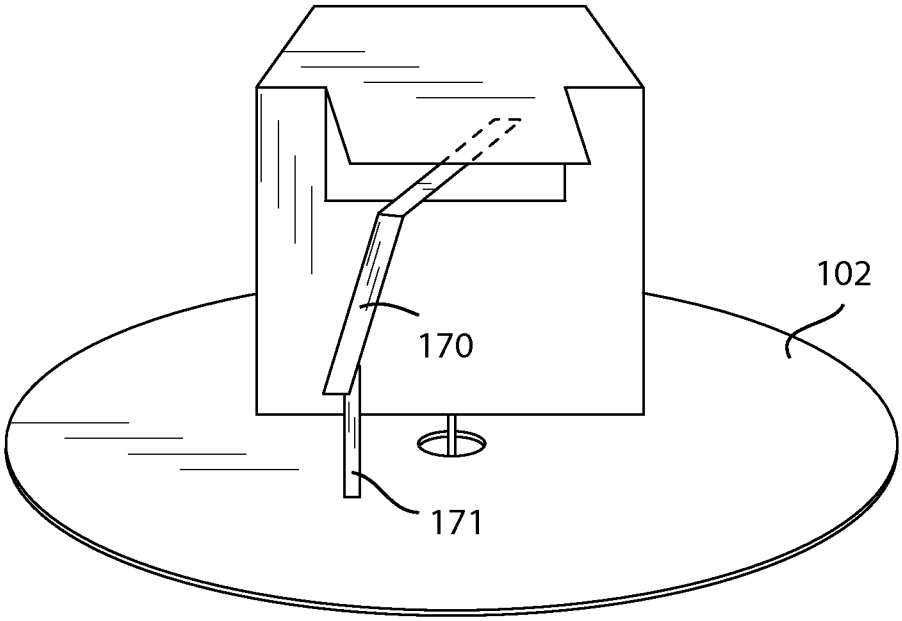
FIG. 14 illustrates an antenna with a parasitic conductor element configured to extend through a vertical plane of the antenna radiator.

FIG. 13 illustrates the antenna further comprising a third conductor referred to herein as a "parasitic conductor element 170" positioned adjacent to the antenna radiator 120 and supported by non-conductive vertical supports 171. One or more vertical supports may be provided, however two vertical supports are being illustrated for simplicity. The parasitic conductive element may be positioned aside the antenna radiator 120 or may be aligned to extend perpendicular with or through the hole 122 of the antenna radiator 120 as illustrated in FIG. 14. The parasitic conductor element 170 can be dimensioned to resonate at a frequency to provide increased bandwidth at one or multiple resonances formed by the antenna radiator and base plate. Although only one parasitic conductor element is being illustrated, it should be understood that two or more parasitic elements may be incorporated in a similar fashion.

Figure 15:
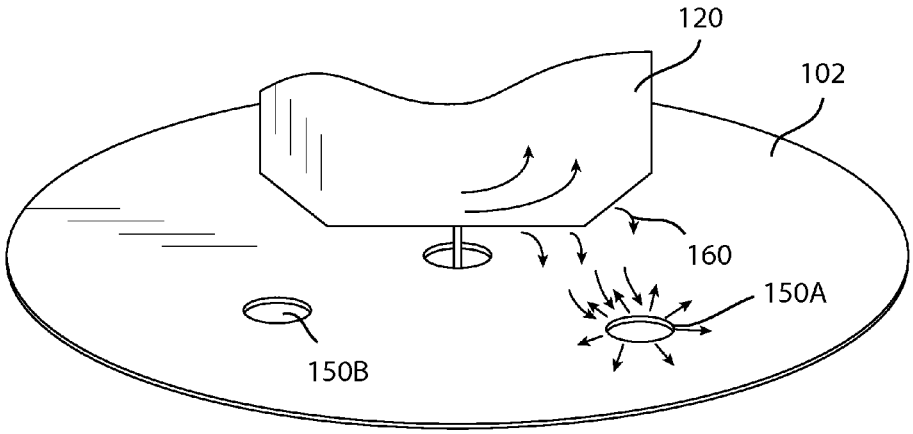
FIGS. 15-16 illustrate the antenna according to various embodiments of the invention and one or more apertures disposed on the antenna base plate; the antenna radiator creating a coupled RF current with the base plate and the apertures creating a reflected RF current.

FIG. 15 illustrates an example of multiple apertures, such as circular holes 150A and 150B, cut into the ground plane 102. RF current 160 on antenna radiator 120 couples to the ground plane 102 and portions of the RF current are reflected from the apertures 150A and 150B, respectively.

Figure 16:
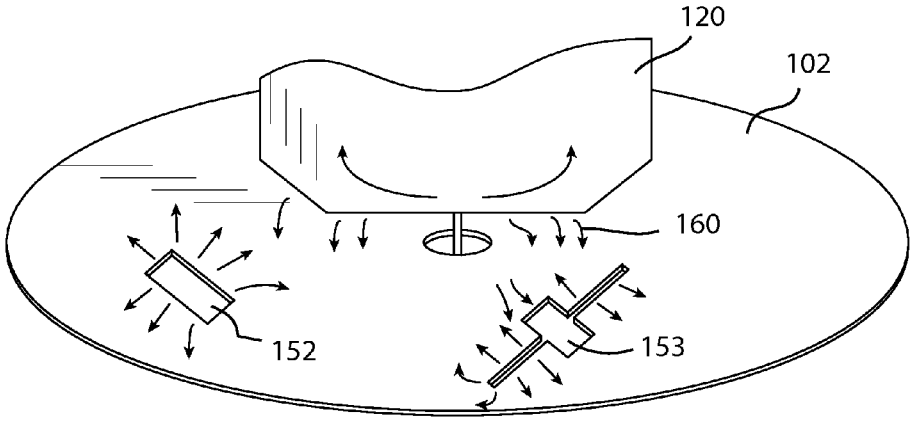

FIG. 16 illustrates an example of multiple apertures, such independent shapes 152 and 153, cut into the ground plane 102. RF current 160 on antenna radiator 120 couples to the ground plane 102 and portions of the RF current are reflected from the apertures 152, and 153, respectively.

Figure 17:
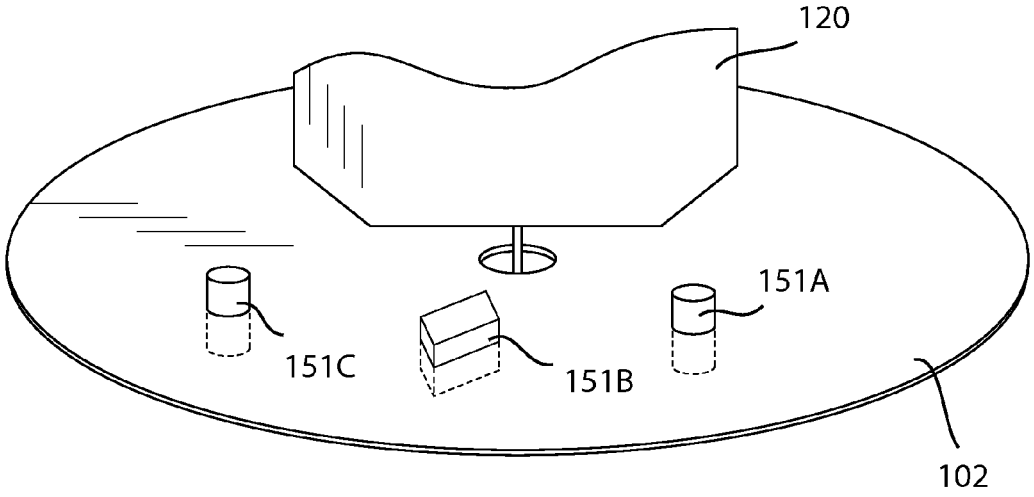
FIG. 17 illustrates dielectric volumes disposed about one or more apertures of the base plate.

FIG. 17 illustrates an example of dielectric volumes 151A, 151B, and 151C inserted into apertures cut into ground plane 102. Antenna radiator 120 is attached to the transmission line conductor 104 of an RF connector. The dielectric volumes are adapted to alter the electrical characteristics of the apertures. The dielectric volumes may comprise distinct dielectric constants, for example where two dielectric volumes and two apertures are provided a first dielectric volume may comprise a first dielectric constant and a second dielectric volume may comprise a second dielectric constant.

Figure 18:
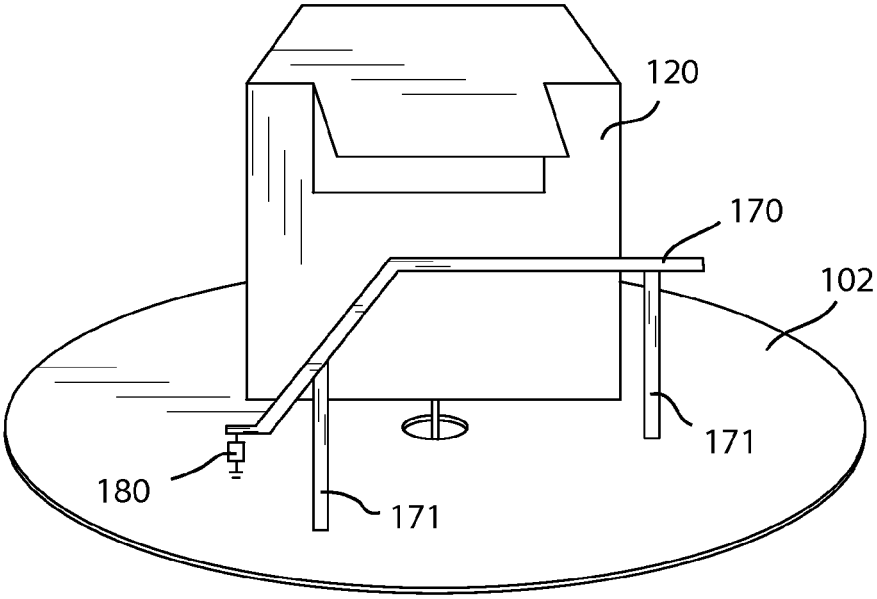
FIGS. 18-19 illustrate the antenna according to various embodiments and further comprising an active4 tuning element connecting the parasitic conductor element to the base plate for providing an ability to alter the antenna radiation pattern.

FIG. 18 illustrates an example of an active component 180 coupled to a parasitic conductor element 170 which is positioned in proximity to antenna radiator 120, which is in turn positioned above a ground plane 102. Non-conductive supports 171 are used to support the parasitic element. The active component is used to alter the impedance of the parasitic element which in turn will alter the frequency response of the antenna radiator 120.

Figure 19:
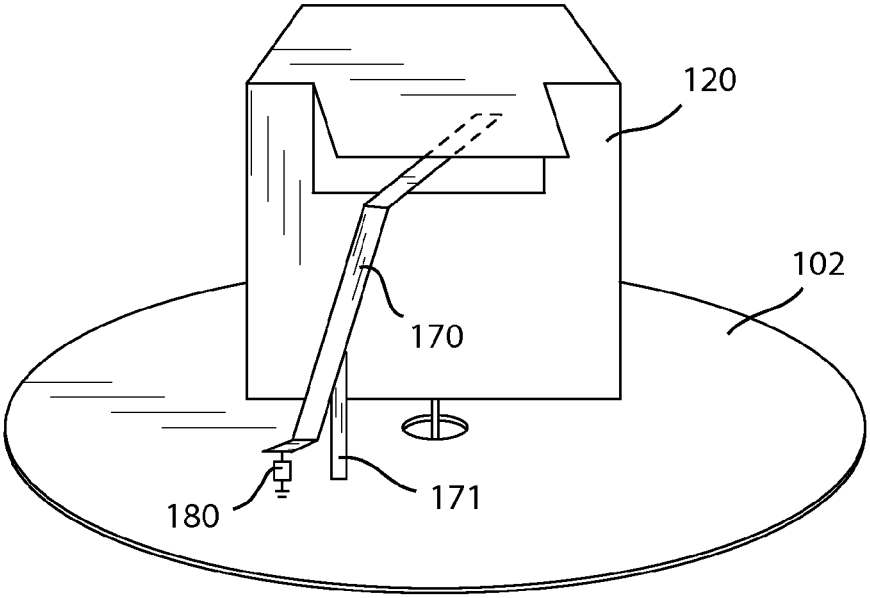

FIG. 19 illustrates an example of an active component 64 coupled to a parasitic conductor element 170 which is positioned in proximity to antenna radiator 120, which is in turn positioned above a ground plane 102. Non-conductive support 171 is used to support the parasitic element. The parasitic element passes through a hole 122 formed in body portion of the antenna radiator 120. The active component is used to alter the impedance of the parasitic element which in turn will alter the frequency response of the antenna radiator 120.

Figure 20:
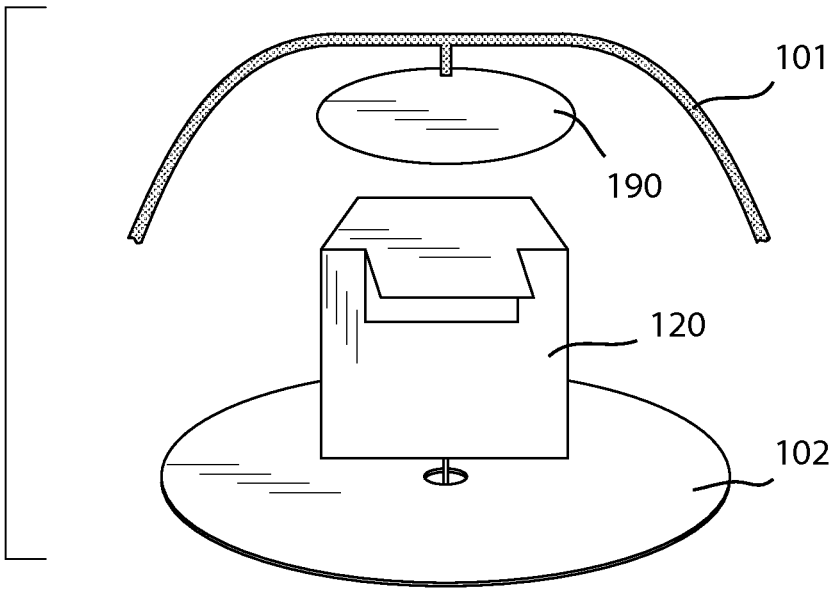
FIGS. 20-21 illustrate the antenna according to various embodiments and further comprising one or more coupled plates disposed within the antenna housing and positioned proximal and parallel to the horizontal top portion of the antenna radiator.

FIG. 20 illustrates an example of a coupled plate conductor 190 positioned in proximity to the horizontal top portion of the antenna radiator 120. Antenna radiator 120 is positioned in proximity to ground plane 102, and antenna radiator 120 is attached to the transmission line conductor of an RF connector. The coupled plate conductor may be embedded or attached to the non conductive housing and arranged thereabout to align adjacent to the antenna radiator when the housing antenna assembly is completely assembled. The coupled plate conductor 190 is adapted to electrically couple with the horizontal top portion of the antenna radiator 120 for changing the radiating characteristics of the antenna.

Figure 21:
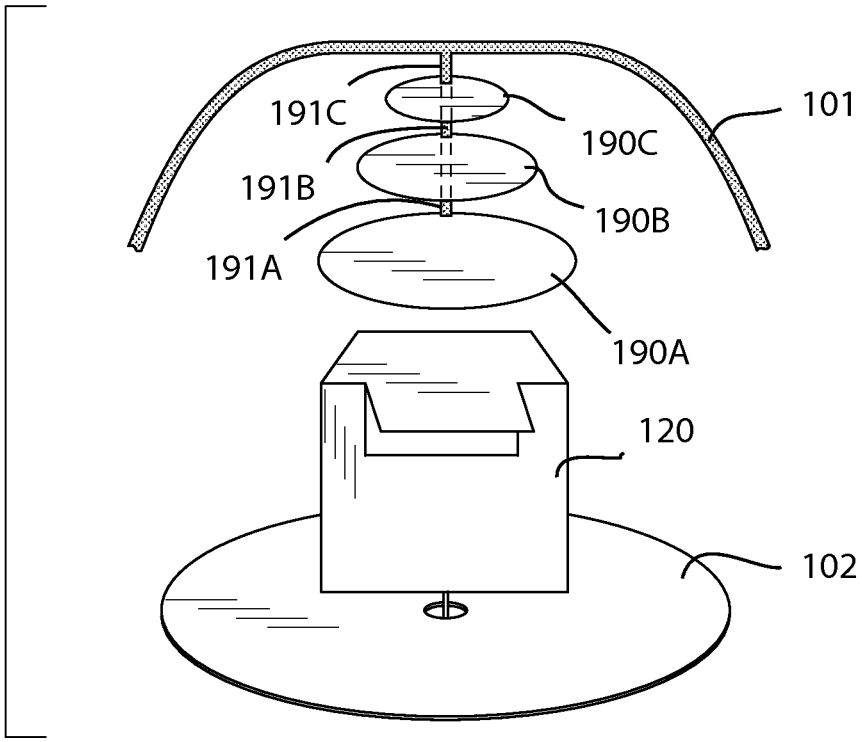

FIG. 21 illustrates an example of multiple coupled plate conductors 190A, 190B, and 190C positioned in proximity to antenna radiator 120. Antenna radiator 120 is positioned in proximity to ground plane 120, and antenna radiator 120 is attached to the transmission line conductor of an RF connector. In this regard, multiple coupling plates are adapted to couple with the antenna radiator for altering radiation characteristics of the antenna. The multiple coupled plate conductors are each individually embedded or attached to the housing 101 using a non-conductive attachment arm 191A, 191B, and 191C.

Figure 22:
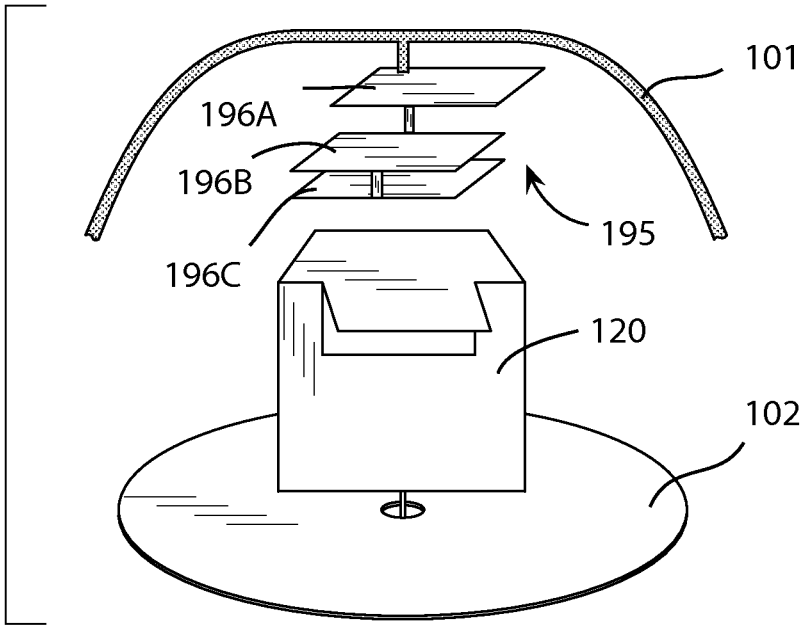
FIGS. 22-23 illustrate the antenna according to various embodiments and further comprising one or more connected plates disposed within the antenna housing and positioned proximal and parallel to the horizontal top portion of the antenna radiator.

FIG. 22 illustrates an example of a connected conductor assembly 195 positioned in proximity to antenna radiator 120. Connected conductor assembly 195 comprises multiple individual conductor plates (196A-C) which are electrically connected to one another. Antenna radiator 120 is positioned in proximity to ground plane 102, and antenna radiator 120 is attached to the transmission line conductor of an RF connector. Because the connected conductors are electrically connected, the changes induced on the antenna radiator are distinct from changes of similarly oriented non-connected conductor plates. As above, the plates can be embedded within or attached to the housing 101.

Figure 23:
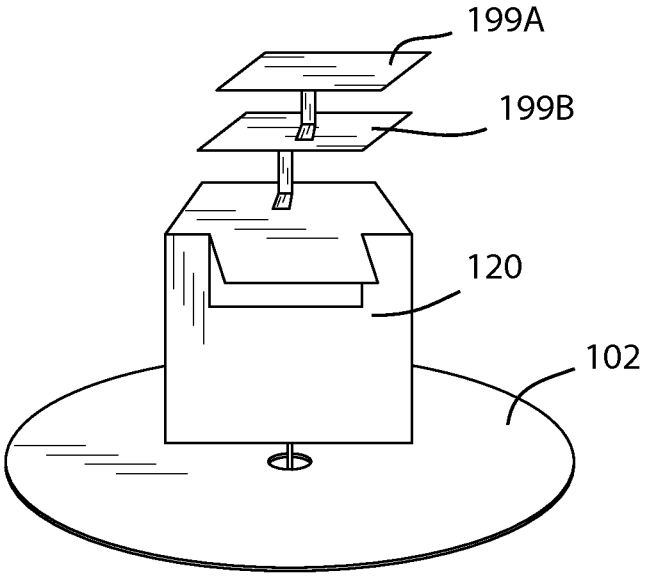

FIG. 23 illustrates an example of attached conductor plates 199A and 199B positioned in proximity to antenna radiator 120. Antenna radiator 120 is positioned in proximity to ground plane 102, and antenna radiator 120 is attached to the transmission line conductor of an RF connector. This embodiment is distinct in that the conductor plates are attached to the antenna radiator at the horizontal top portion.

Figure 24:
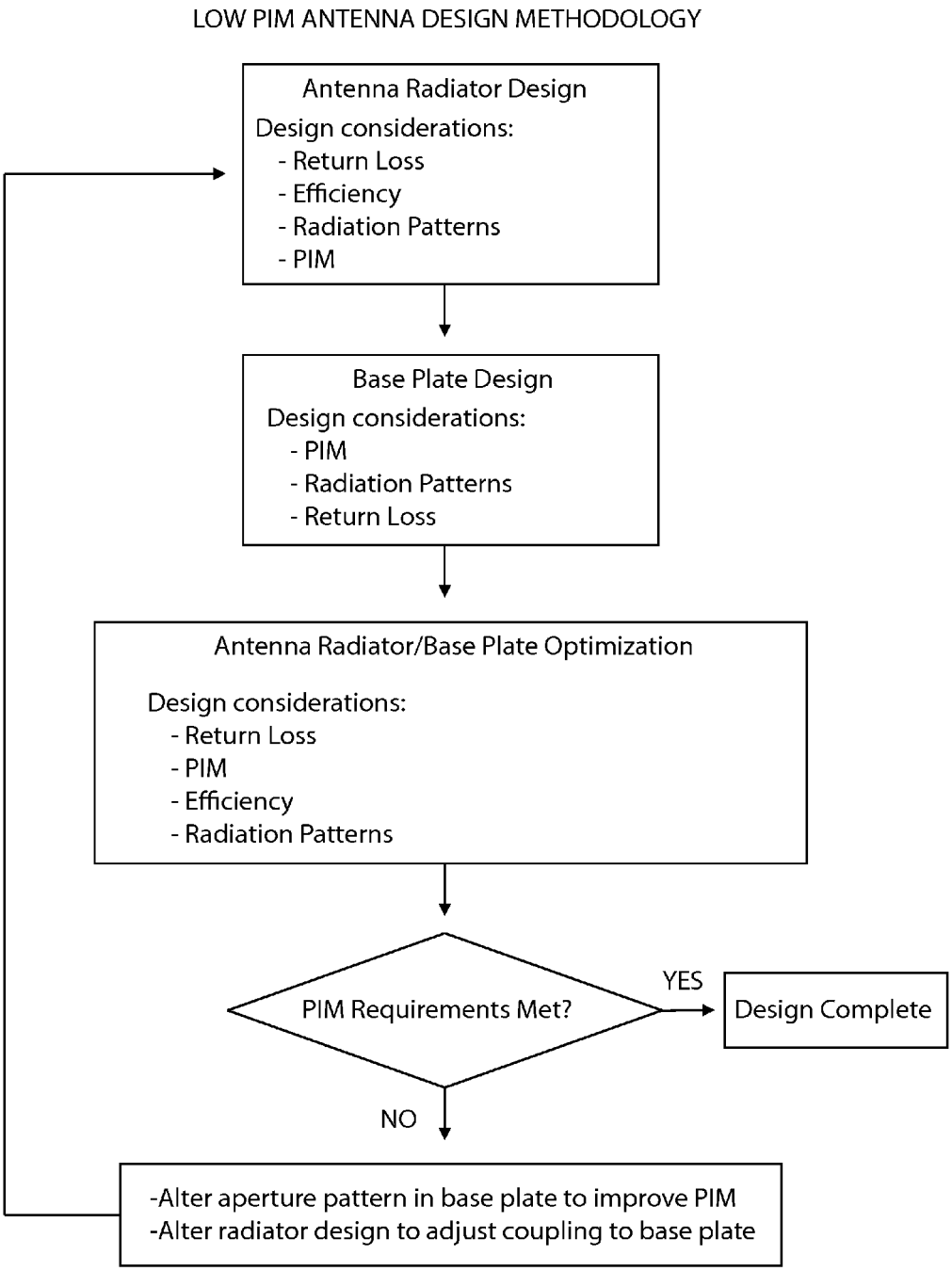
FIG. 24 is a schematic representing a low PIM antenna design methodology.

FIG. 24 illustrates a design methodology for a low PIM antenna. The methodology includes antenna radiator design, base plate design, antenna radiator and base plate optimization, and testing for PIM requirements. Antenna radiator design includes consideration of return loss, efficiency, radiation patterns, and PIM. Base plate design includes consideration of PIM, radiation patterns, and return loss. Antenna radiator and base plate optimization includes consideration of return loss, PIM, efficiency, and radiation patterns. Once the antenna is prototyped, the antenna characteristics are measured and the antenna is determined to pass or fail PIM requirements. If failing PIM testing, the aperture pattern in the base plate is altered, and/or the antenna radiator is altered to adjust coupling with the base plate. The process is repeated until an antenna design is completed whereas the resulting antenna meets PIM requirements.

The invention claimed is:

1. An antenna assembly, comprising:

an antenna radiator extending vertically from a ground plane;

the ground plane comprising a horizontally disposed conductive plate; and the antenna radiator formed from a monolithic conductor plate being cut and bent to form a vertically oriented planar body portion and a horizontal top portion disposed substantially perpendicular to the planar body portion;

the antenna radiator connected to a transmission line conductor of a coaxial connector for driving the antenna radiator;

wherein the antenna radiator is attached to the ground plane at a non-conductive support bracket; and wherein a non-conductive housing is positioned to contain the antenna radiator and ground plane therein.

2. The antenna assembly of claim 1, wherein a hole is disposed between the top portion and body portion of the antenna radiator.

3. The antenna assembly of claim 1, wherein said top portion of the radiator is disposed parallel with respect to the ground plane.

4. The antenna assembly of claim 1, further comprising one or more configurable flap portions cut from the body portion of the antenna radiator and adapted for bendable configuration.

5. The antenna assembly of claim 4, wherein said configurable flap portions are independently configured to form acute, right, or obtuse angles with respect to the body portion of the antenna radiator.

6. The antenna assembly of claim 1, further comprising one or more apertures disposed on the ground plane.

7. The antenna assembly of claim 6, further comprising a dielectric volume of material disposed one of the apertures.

8. The antenna assembly of claim 6, comprising two or more apertures each having a distinct shape and size.

9. The antenna assembly of claim 8, comprising a separate dielectric volume of material disposed at each of the two or more apertures.

10. The antenna assembly of claim 9, wherein each of the dielectric volumes individually comprises a distinct dielectric constant thereof.

11. The antenna assembly of claim 1, comprising at least one parasitic element disposed adjacent to the antenna radiator.

12. The antenna assembly of claim 11, wherein said parasitic element extends through a hole formed from the cut and bend top portion of the radiator.

13. The antenna assembly of claim 11, further comprising an active tuning element connecting one of the parasitic elements to the ground plane.

14. The antenna assembly of claim 1, further comprising one or more conductor plates disposed above the antenna radiator, the conductor plates being disposed parallel with respect to the horizontal top portion of the antenna radiator.

15. The antenna assembly of claim 14, comprising two or more conductor plates disposed above the antenna radiator, the two or more conductor plates being electrically connected to one another.

16. The antenna assembly of claim 15, wherein the conductor plates are connected to the antenna radiator at a top portion thereof.

17. A method for fabricating an antenna assembly, comprising:

forming a u-shape cut into a first planar conductive plate;

bending the first planar conductive plate at the u-shape cut to form a horizontally disposed top portion and a vertically oriented body portion of an antenna radiator, the antenna radiator having a t-shape structure when viewed form a side thereof;

cutting one or more apertures into a second planar conductive plate to form a ground plane; and orienting the antenna radiator above the ground plane.

* * * * *